United States Patent [19]

Long

[11] 4,214,393

[45] Jul. 29, 1980

[54] COUNTERBALANCE DISPLAY SIGN

[75] Inventor: Charles H. Long, Ormond Beach, Fla.

[73] Assignee: Stout Industries, Inc., St. Louis, Mo.

[21] Appl. No.: 967,243

[22] Filed: Dec. 7, 1978

Related U.S. Application Data

[63] Continuation of Ser. No. 857,658, Dec. 5, 1977, abandoned, which is a continuation of Ser. No. 732,505, Oct. 14, 1976, abandoned.

[51] Int. Cl.[3] ..... G09F 19/00

[52] U.S. Cl. ..... 40/613

[58] Field of Search ..... 40/602, 606, 607, 613, 40/616; 116/63 R, 63 P

[56] References Cited

U.S. PATENT DOCUMENTS

| | | | |
|---|---|---|---|
| 664,049 | 12/1900 | Johnson | 40/613 |
| 1,824,444 | 9/1931 | Mueller et al. | 40/602 |
| 2,054,230 | 9/1936 | Patterson | 40/613 |
| 2,467,187 | 4/1949 | Capper | 40/613 |
| 3,088,235 | 5/1963 | Kies | 40/613 X |

*Primary Examiner*—Louis G. Mancene
*Assistant Examiner*—Wenceslao J. Contreras
*Attorney, Agent, or Firm*—Kalish & Gilster

[57] ABSTRACT

A display sign for outdoor utilization and designed for resisting overturning under strong wind conditions incorporating a relatively enlarged flat panel for carrying an advertising message. A standard for said sign comprising uprights, with the sign being pivotally engaged in its side margins to said uprights for normal swingable action against a transversely extending pivot axis. Said axis is located for coincidence with a line passing through the upper limit of the lower third of said sign and with there being counterweights mounted fixedly at the lower end of said sign for establishing a relatively low center of gravity as well as a predetermined ratio between the lower third and upper two-thirds of said sign to prevent overturning as well as windmill movement during high wind conditions.

2 Claims, 13 Drawing Figures

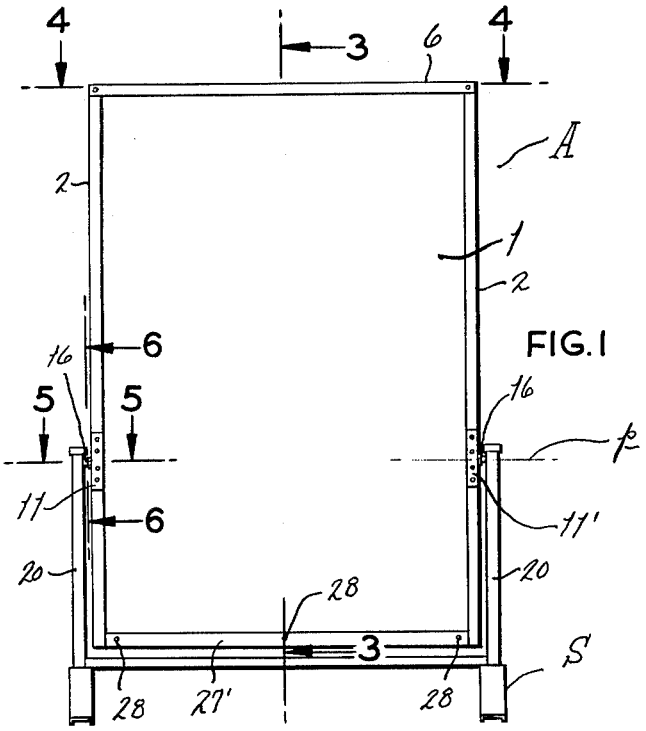
FIG. 1
FIG. 2
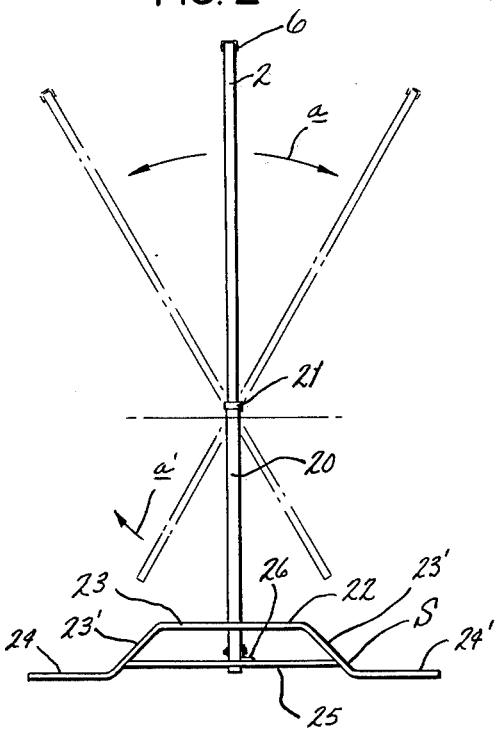
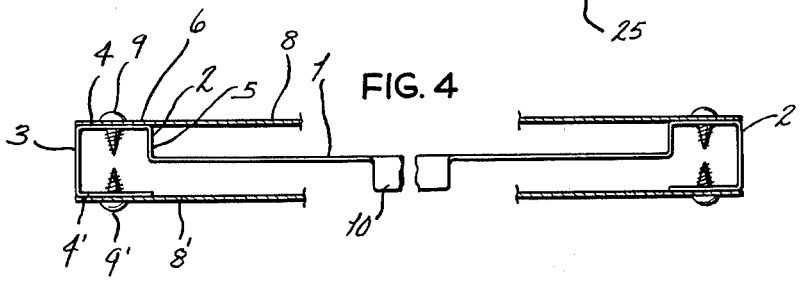
FIG. 4
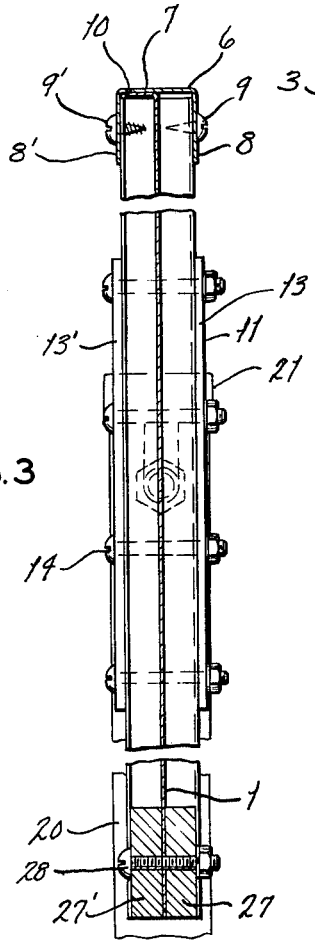
FIG. 3
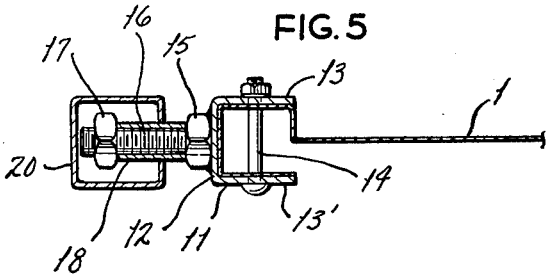
FIG. 5
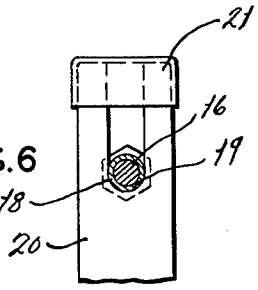
FIG. 6

FIG. 7
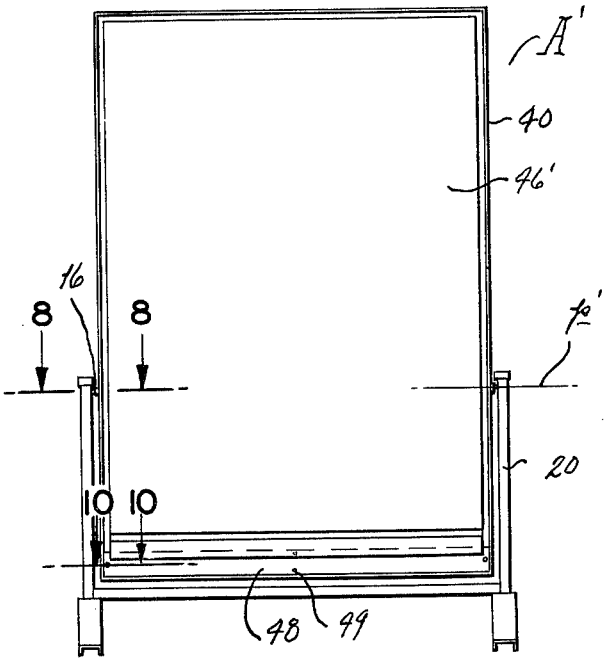
FIG. 8
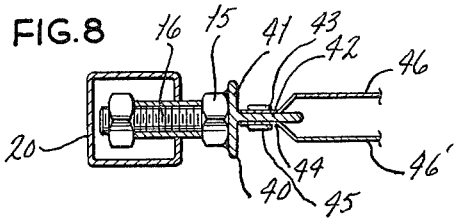
FIG. 9
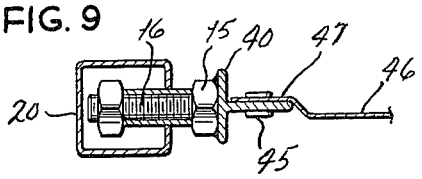
FIG. 10
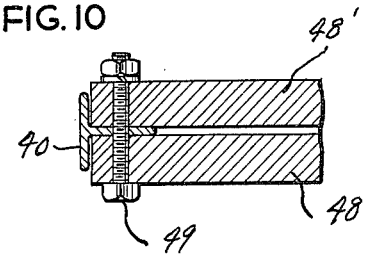
FIG. 11
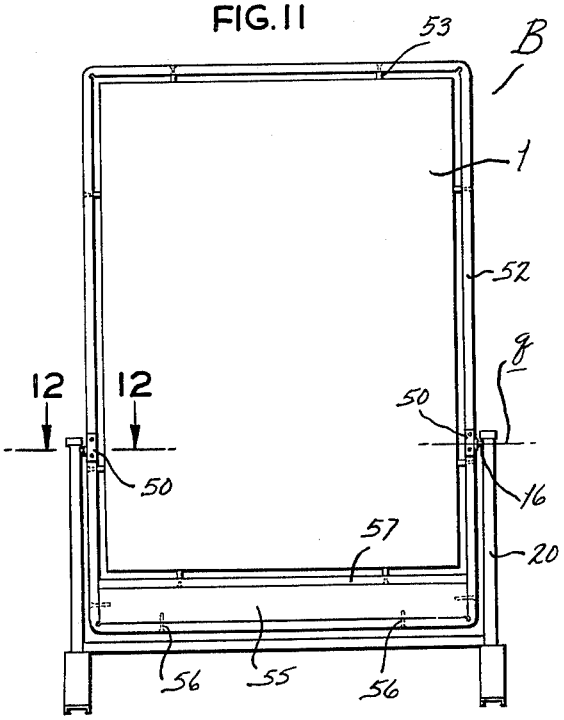
FIG. 12
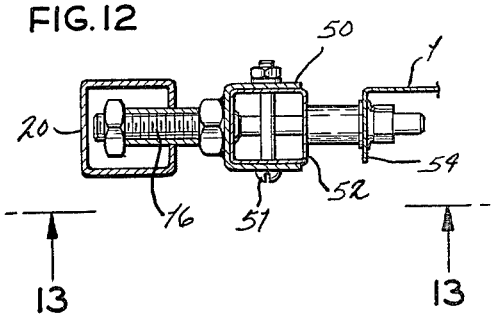
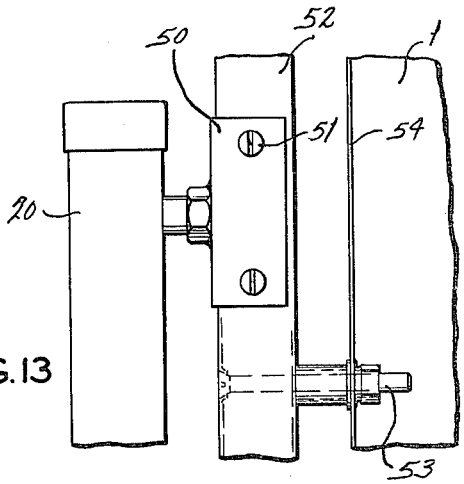
FIG. 13

COUNTERBALANCE DISPLAY SIGN

This is a continuation of application Ser. No. 857,658 filed Dec. 5, 1977, now abandoned, which is a continuation of Ser. No. 732,505, filed Oct. 14, 1976, now abandoned.

BACKGROUND AND SUMMARY OF THE INVENTION

This invention relates in general to display devices and, more particularly, to certain new and useful improvements in outdoor signs.

With numerous commercial establishments, generally of the retail character, it has become an ever-increasing practice to utilize out-of-door display signs on the premises of the establishment for publicizing wares and/or prices therefor. Signs of this particular type have gained widespread usage particularly in the field of gasoline stations wherein the attention of motorists have been gained at relative distances for advice as to the particular items available and the charges therefor. Signs of this type are of such relative size that, if desired, the same may be removed to an indoor location for security purposes after business hours.

However, with signs of this type there has been the continual problem of developing same in such a manner so as to prevent overturning through wind forces. To solve this problem, efforts have been made at providing relatively enlarged base structures which have proved costly, as well as requiring relatively extensive support areas, detracting from the operational use of portions of the premises. But even with enlarged bases there has been no assurance against overturning. Another effort has entailed rendering such signs permanently installed, but such is indeed costly and denies desired economic utilization of the available areas.

Therefore, it is an object of the present invention to provide an outdoor sign of the character stated which is relatively compact and of such limited weight as to render same comfortably transportable by the average attendant, and which sign is resistant to overturning under high wind conditions.

It is another object of the present invention to provide a sign of the character stated which encompasses a relatively enlarged display surface so as to present material capable of arresting attention at a substantial distance.

It is a further object of the present invention to provide a sign of the character stated which is uniquely constructed in a most economic manner, being amenable to high volume production; which comprises a marked simplicity of sturdy components so as to be durable in usage; and which, being extremely versatile in use, has widespread application for commercial and related purposes.

BREIF DESCRIPTION OF THE DRAWINGS

FIG. 1 is a front view of an outdoor display sign constructed in accordance with and embodying the present invention.

FIG. 2 is a side elevational view demonstrating the rockability of the sign under wind pressures.

FIG. 3 is a vertical transverse sectional view taken on the line 3—3 of FIG. 1. FIG. 4 is a fragmentary horizontal transverse sectional view taken on the line 4—4 of FIG. 1.

FIG. 5 is a horizontal transverse sectional view taken on the line 5—5 of FIG. 1.

FIG. 6 is an elevational view taken on the line 6—6 of FIG. 1.

FIG. 7 is a front view of another form of an outdoor display sign constructed in accordance with and embodying the present invention.

FIG. 8 is a horizontal transverse sectional view taken on the line 8—8 of FIG. 7.

FIG. 9 is a horizontal transverse sectional view taken substantially on the line 8—8 of FIG. 7, but illustrating another form of display sign.

FIG. 10 is a horizontal transverse sectional view taken on the line 10—10 of FIG. 7.

FIG. 11 is a front elevational view of a still further form of outdoor display sign constructed in accordance with and embodying the present invention.

FIG. 12 is a horizontal transverse sectional view taken on the line 12—12 of FIG. 11.

FIG. 13 is an enlarged fragmentary front view taken on the line 13—13 of FIG. 12.

DESCRIPTION OF THE PREFERRED EMBODIMENTS

Referring now by reference characters to the drawings which illustrate preferred embodiments of the present invention, A generally designates a display sign designed particularly for outdoor usage, such as, for instance only, disposition upon the premises of a gasoline station. Said sign A comprises a preferably enlarged unitary display panel 1, as formed of aluminum, stainless steel, or the like which may have any predetermined contour but is preferably quadrilateral in configuration. In normal usage the display panel may have applied directly thereon by suitable paints and the like the particular preselected promotional message or, if desired, may be adapted to support a multiplicity of individual discrete plates (not shown) for removable mounting thereon in order to permit of a quick change of advertising, all as in accordance with well known practice.

Panel 1 is approximately formed in its vertical marginal portions into general box formation, as at 2, having and end wall 3, parallel side walls 4,4', and a short inner wall 5 so that the plane of panel 1, if extended, would coincide with the transverse center line of said marginal portions 2. The latter provide relative strength and physical integrity to panel 1 so that it may be fabricated of relatively light gage material. Disposed upon the upper end of panel 1 is a channel closure 6 having a top web 7 and depending flanges 8,8' which in their end portions abut against the confronting side walls 4,4' of the marginal portions of display panel 1 and are suitably affixed thereto as by screws 9,9', respectively. Centrally of its upper margin display panel 1 is provided with a relatively short flange 10 which abuts against the under surface of web 7 of closure 6 promoting rigidity of panel 1.

Panel 1 is designed to swing about a transversely extending pivot axis, as indicated at p, which is located two-thirds the length of panel from its upper end edge, or, in other words, one-third upwardly from its bottom edge, so that said panel 1 is thus adapted to swing about an eccentric axis. To effect such swingability, channel shaped brackets 11,11' each having outer or exterior web portions 12, and inturned parallel flanges 13,13', are secured upon the respective marginal portions 2 of display panel 1 with flanges 13,13' abutting the proximate portions of side walls 4,4' and with web 12 disposed against the outer face of outer wall 3 (see FIG. 5); with such brackets 11 being retained by a plurality of vertically spaced bolts 14 which extend through aligned openings in flange 13', wall 4', wall 4, and flange 13. As may best be seen in FIGS. 1 and 3, four such bolts 14 are shown, although any suitable number may be used for firmly stabilizing brackets 11 in appropriate dispostion.

Rigid with the outer face of web 12 of each bracket is the head 15 of a pivot pin forming member 10 which extends laterally outwardly and may be constituted of a bolt for engaging a retaining nut 17 proximate its outer end with there being a spacer 18, as formed by nylon, between said head 15 and nut 17. Said pivot pin 16 is thus coaxial with a like pin on the opposite side of display panel 1 so as to establish therebetween the aforesaid pivot axis p which coincides with a line demarcating the upper limit of the lower third of said panel 1. Each pivot pin 16 in actuality constitutes a trunion for acceptance within an upwardly opening bearing 19 formed in the inner or confronting wall of a related support post 20 of a base or standard S. It will be seen that said posts 20 are disposed on either side of display panel 1, laterally outwardly thereof and coplanar therewith when said panel 1 is in vertical disposition. Each post 20 may be formed of suitable tube stock, such as preferably square in cross section, and receives a detachable cap or closure 21 so as to limit any undesired upward movement of pins 16 within their respective bearings 19. Standard S which comprises a base element 22 for directly supporting each post 20. Said base elements are each preferably formed of suitable channel or strap stock having a central elevated portion 23 which are continuous at each of their ends, through downwardly inclined sections, as at 23', to normally forward and rearward flat foot members 24,24' which engage the particular support surface. Each post 20 projects through an opening (not shown) in the elevated portion 23 of the related base element 22 with its lower end extremity terminating downwardly thereof but slightly upwardly of the particular support surface for engagement to a brace 25 fixed at its ends to the opposed inclined sections 23' for rigidifying the related standard S. Said posts 20 are engaged in any suitable manner to said braces 25 as, for example, by means of an angle bracket 26.

In view of the foregoing, it will be seen that standard S with its base elements 22 provides a firm but yet relatively compact stable foundation for sign A permitting same to be readily transportable between selected sites and without necessitating affixation to the support surface and with panel 1 being swingable about its critically located pivot axis.

Turning now to FIG. 3 it will be seen that panel 1 in its lower end portion between its box-formed marginal portions 2 is tightly sandwiched between a pair of weighted elements, such as, bars 27,27', which are suitably fixed to each other and to the intervening portion of panel 1 as by spaced bolts, at 28. Said bars 27,27' constitute counterweights so as to establish a relative weight relationship between that portion of panel 1 between pivot axis 16 and its bottom edge margin and the remaining or upper portion of said panel 1 between said pivot axis p and the top margin of said panel 1. Generally speaking, the ratio is approximately between 2½ and 3 to 1, so that the lower section, below said pivot axis, is of substantially greater weight than the upper portion. This unique and critical weight relationship between the aforesaid upper and lower sections renders sign A resistant to toppling or even windmill-type action under substantial wind pressures such as are normally encountered from time to time with outdoor signs due to the usual weather variations.

The unique function developed by this relationship may be best illustrated in FIG. 2 wherein the arrows indicate directions of the wind against panel 1. It will be seen that as, for instance, sign A is being driven in its upper portion, as by arrow a to the right of FIG. 2, the lower portion will be conversely caused to move upwardly in a direction indicated by arrow a' and thereby present such lower surface to the wind force. Consequently, the counterbalance lower portion serves as a ballast which will tend to resist upward swinging by reason of the gravitational effect, together with a relatively low center of gravity of sign A since the major portion of the weight is below the pivot axis. Consequently, by such resistance to wind action, the lower portion of said sign A will not be sufficiently raised to permit the wind to strike its opposed surface and thereby effect a driving action which would cause a windmill effect, but moreso, would cause the sign to topple in view of the fact that the upper portion presents a relatively enlarged sail surface against which the wind pressure may operate. Patently, sign A's resistance to overturning is the same in the opposite direction. Thus, since the lower portion provides a restraint against swinging, its wind directed surface also enjoys the benefit of the wind pressure tending to return same to vertical position.

Therefore, in view of the foregoing, sign A is uniquely constructed to be relatively lightweight; yet present a maximum of display surface; but be resistant to overturning under severe wind forces and thus be preserved against damage from overturning as well as obviating relatively constant attendant concern with entailed removability under inclement weather conditions.

Turning now to FIG. 7, another form of display sign, indicated A', is disclosed which is fundamentally both structurally and functionally immeidately similar to sign A and being designed to bring about the unique resistance to overturning. Sign A' comprises numerous components corresponding to those incorporated in sign A above described so that such elements will bear like reference numerals for purposes of facilitating description.

Sign A' differs essentially from sign A in utilizing a unitary frame 40 which is of preferably cast form and being T-shaped in cross section, the head 41 of which is disposed laterally outwardly for securement to the heads 15 of pivot pins 16 which are related to posts 20 as shown with respect to sign A. The stem or leg portion 42 of frame 40 projects inwardly with its opposite sides, as at 43,44, being presented for engagement as by rivets 45 to design panels 46. With reference to FIG. 8 it will be seen that sign A' may be used with a pair of such design panels, such as at 46,46' which may be aluminum sheets suitably embossed on their exterior surfaces for advertising purposes and being marginally flanged as at 47, as through panning, for flatwise securement to the adjacent side face of stem 42 of frame 40 as by rivets 45. Thus, as may best be seen in FIGS. 8 and 9, either a single panel 46 may be used or a pair of panels 46,46' may be mounted at the election of the user. Said pivot pins 16 are so located with respect to sign A' as to establish a pivot axis p' coincident with a line extending through the upper margin of the lower third of such sign A′ and with there being weighted bars 48,48′ extending transversely of sign A′ abutting on their inner end portions against opposite side faces of stems 42 of the related frames 40 and with suitable fasteners, such as bolts 49, rigidly retaining weighted bars 48,48′ in position. Sign A′ is of generally lightweight ratio as sign A above described, wherein the portion below pivot axis p′ is between 2½ to 3 times the weight above for rendering sign A′ resistant to overturning or toppling in the same manner as sign A above described.

With reference now being made to FIGS. 11, 12 and 13 another form of sign B constructed in accordance with the present invention may be utilized, if desired, for like purpose as the aforesaid signs A,A′, and which sign B embodies various elements which are incorporated in the aforesaid above described signs so that like elements will bear the same reference numerals. It is to be particularly noted that sign B has a pivot axis q coinciding with the line passing through the upper limit of the lower third of sign B; said axis q being thus defined by pivot pins 16 which are rockably mounted in posts 20 in the same manner as hereinbefore set forth with the other versions of this invention and with said pins 16 being rigid at their inner ends with channel shaped mounting brackets 50 secured as by bolts 51 upon the confronting faces of a panel frame 52 which in the present structure is desirably of tubular form and preferably of square cross section. Panel 1 is mounted upon tubular frame 52 spacedly about its margins by means of spacer-encased fasteners, indicated at 53, which progress through frames 52 and through marginal flanges 54 provided on the said design panel 1. The particular mounting of panel 1 upon frame 52 does not form a part of the present invention, but merely reveals another currently used design panel mounting which is amenable to incorporation in an overall design having a pivot axis, as indicated for rendering sign B equally resistant to overturning or toppling as signs A,A′ above described.

With reference to FIG. 11, it will be seen that a weighted element 55 as of bar shape is fixed within the lower end of frame 52 extending transversely thereof and being made secure against displacement as by fasteners 56 to the lower section of said frame 52 as well as to a transverse component 57 progressing through the lower side portions thereof for compactly accepting counterbalance weight 35.

The weight relationship of the upper and lower thirds of sign B is the same as that as signs A,A′ above described, with such lower portion having an overall weight of between 2 and 3 times of that of the upper third so that sign B is as resistant to overturning as signs A and A′ above described.

Having described my invention what I claim and desire to obtain by Letters Patent is—

1. A display sign comprising a normally vertically disposed, relatively thin, normally non-air resistant panel for inscription of promotional and informational material thereon, said panel having lateral marginal portions contoured into general box-like configuration, channel-shaped members secured on said panel marginal portions, transversely aligned pivot pins projecting laterally outwardly from opposite lateral marginal portions of said panel and being fixed thereon, an upright presented in laterally spaced relationship to each panel marginal portion, said pivot pins being received in the outer portions thereof within each of said upright supports thereby rendering said panel swingable within a vertical plane about said uprights, said pivot pins developing a transverse pivot axis demarcating the upper limit of a zone constituting the lower third portion of said panel, counterweights secured to the lower end portion of said panel on opposite faces thereof and between the lateral marginal portions thereof for movement therewith and being spacedly below said pivot axis, said counterweights being of such weight that when combined with the weight of the panel below said pivot axis will approximate between two and three times the weight of the panel above said pivot axis thereby preventing said display sign from overturning under impact of strong winds.

2. A display sign as defined in claim 1 and further characterized by a standard for engaging the support surface, said uprights being mounted upon said standard and projecting upwardly therefrom, each of said uprights incorporating bearings for receiving the related pivot pin.

* * * * *